US011217942B2

(12) United States Patent
Lu

(10) Patent No.: US 11,217,942 B2
(45) Date of Patent: Jan. 4, 2022

(54) CONNECTOR HAVING METAL SHELL WITH ANTI-DISPLACEMENT STRUCTURE

(71) Applicant: Amphenol East Asia Ltd., Taoyuan (TW)

(72) Inventor: Lo-Wen Lu, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 0 days.

(21) Appl. No.: 16/684,755

(22) Filed: Nov. 15, 2019

(65) Prior Publication Data

US 2020/0161811 A1 May 21, 2020

(30) Foreign Application Priority Data

Nov. 15, 2018 (TW) ..... 107215544

(51) Int. Cl.

| | |
|---|---|
| ***H01R 13/648*** | (2006.01) |
| ***H01R 13/6581*** | (2011.01) |
| ***H01R 13/506*** | (2006.01) |
| *H01R 24/60* | (2011.01) |

(52) U.S. Cl.

CPC ..... *H01R 13/6581* (2013.01); *H01R 13/506* (2013.01); *H01R 24/60* (2013.01)

(58) Field of Classification Search

CPC . H01R 12/00; H01R 13/6587; H01R 13/6594
USPC ..... 439/607.4, 607.35, 607.32, 607.33
See application file for complete search history.

(56) References Cited

U.S. PATENT DOCUMENTS

| | | | |
|---|---|---|---|
| 2,996,710 | A | 8/1961 | Pratt |
| 3,002,162 | A | 9/1961 | Garstang |
| 3,134,950 | A | 5/1964 | Cook |
| 3,322,885 | A | 5/1967 | May et al. |
| 3,786,372 | A | 1/1974 | Epis et al. |
| 3,825,874 | A | 7/1974 | Peverill |
| 3,863,181 | A | 1/1975 | Glance et al. |

(Continued)

FOREIGN PATENT DOCUMENTS

| | | | |
|---|---|---|---|
| CN | 1192068 | A | 9/1998 |
| CN | 2519434 | Y | 10/2002 |

(Continued)

OTHER PUBLICATIONS

U.S. Appl. No. 16/742,594, filed Dec. 19, 2019, Lu.

(Continued)

*Primary Examiner* — Phuong K Dinh
(74) *Attorney, Agent, or Firm* — Wolf, Greenfield & Sacks, P.C.

(57) ABSTRACT

A connector with a metal shell having an anti-displacement structure. The connector comprises an insulating base, a plurality of metal terminals and a metal shell. A side arm of the metal shell has a first upper fixing part, a first lower fixing part and a first positioning part. The first upper fixing part abuts an upper surface of the insulating base, and the first lower fixing part abuts a lower surface of the insulating base. The first positioning part is combined with a second positioning part on a side face of the insulating base. In this way, the insulating base is restrained from moving upward, downward, leftward or rightward relative to the metal shell, thereby effectively improving the assembly stability of the connector.

20 Claims, 4 Drawing Sheets

(56) References Cited

U.S. PATENT DOCUMENTS 4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,687,267 A 8/1987 Header et al.
4,728,762 A 3/1988 Roth et al.
4,751,479 A 6/1988 Parr
4,761,147 A 8/1988 Gauthier
4,787,548 A 11/1988 Abbagnaro et al.
4,806,107 A 2/1989 Arnold et al.
4,846,724 A 7/1989 Sasaki et al.
4,846,727 A 7/1989 Glover et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,171,161 A 12/1992 Kachlic
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,885,088 A 3/1999 Brennan et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,202 B1 1/2001 Mitra
6,174,203 B1 1/2001 Asao
6,174,944 B1 1/2001 Chiba et al.
6,217,372 B1 4/2001 Reed
6,293,827 B1 9/2001 Stokoe
6,296,496 B1 10/2001 Trammel
6,299,438 B1 10/2001 Sahagian et al.
6,299,483 B1 10/2001 Cohen et al.
6,322,395 B1 11/2001 Nishio et al.
6,328,601 B1 12/2001 Yip et al.
6,347,962 B1 2/2002 Kline
6,350,134 B1 2/2002 Fogg et al.
6,361,363 B1 3/2002 Hwang
6,364,711 B1 4/2002 Berg et al.
6,375,510 B2 4/2002 Asao
6,379,188 B1 4/2002 Cohen et al.
6,394,842 B1 5/2002 Sakurai et al.
6,398,588 B1 6/2002 Bickford
6,409,543 B1 6/2002 Astbury, Jr. et al.
6,447,170 B1 9/2002 Takahashi et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,551,140 B2 4/2003 Billman et al.
6,554,647 B1 4/2003 Cohen et al.
6,565,387 B2 5/2003 Cohen
6,565,390 B2 5/2003 Wu
6,579,116 B2 6/2003 Brennan et al.
6,582,244 B2 6/2003 Fogg et al.
6,595,801 B1 7/2003 Leonard et al.
6,595,802 B1 7/2003 Watanabe et al.
6,602,095 B2 8/2003 Astbury, Jr. et al.
6,607,402 B2 8/2003 Cohen et al.
6,609,922 B2 8/2003 Torii
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,726,492 B1 4/2004 Yu
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,086,872 B2 8/2006 Myer et al.
7,094,102 B2 8/2006 Cohen et al.
7,104,842 B1 9/2006 Huang et al.
7,108,556 B2 9/2006 Cohen et al.
7,156,672 B2 1/2007 Fromm et al.
7,163,421 B1 1/2007 Cohen et al.
7,232,344 B1 6/2007 Gillespie et al.
7,285,018 B2 10/2007 Kenny et al.
7,318,740 B1 1/2008 Henry et al.
7,320,614 B2 1/2008 Toda et al.
7,322,845 B2 1/2008 Regnier et al.
7,331,822 B2 2/2008 Chen
7,335,063 B2 2/2008 Cohen et al.
7,364,464 B2 4/2008 Iino et al.
7,407,413 B2 8/2008 Minich
7,467,977 B1 12/2008 Yi et al.
7,473,124 B1 1/2009 Briant et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,604,502 B2 10/2009 Pan
7,645,165 B2 * 1/2010 Wu ..... H01R 13/6582
439/607.38
7,690,946 B2 4/2010 Knaub et al.
7,699,644 B2 4/2010 Szczesny et al.
7,722,401 B2 5/2010 Kirk et al.
7,727,027 B2 6/2010 Chiang et al.
7,727,028 B1 6/2010 Zhang et al.
7,731,537 B2 6/2010 Amleshi et al.
7,753,731 B2 7/2010 Cohen et al.
7,771,233 B2 8/2010 Gailus
7,789,676 B2 9/2010 Morgan et al.
7,794,240 B2 9/2010 Cohen et al.

(56) References Cited

U.S. PATENT DOCUMENTS

| | | | |
|---|---|---|---|
| 7,794,278 | B2 | 9/2010 | Cohen et al. |
| 7,806,729 | B2 | 10/2010 | Nguyen et al. |
| 7,824,192 | B2 | 11/2010 | Lin et al. |
| 7,871,296 | B2 | 1/2011 | Fowler et al. |
| 7,874,873 | B2 | 1/2011 | Do et al. |
| 7,883,369 | B1 | 2/2011 | Sun et al. |
| 7,887,371 | B2 | 2/2011 | Kenny et al. |
| 7,887,379 | B2 | 2/2011 | Kirk |
| 7,906,730 | B2 | 3/2011 | Atkinson et al. |
| 7,914,304 | B2 | 3/2011 | Cartier et al. |
| 7,985,097 | B2 | 7/2011 | Gulla |
| 8,018,733 | B2 | 9/2011 | Jia |
| 8,083,553 | B2 | 12/2011 | Manter et al. |
| 8,123,544 | B2 | 2/2012 | Kobayashi |
| 8,182,289 | B2 | 5/2012 | Stokoe et al. |
| 8,215,968 | B2 | 7/2012 | Cartier et al. |
| 8,216,001 | B2 | 7/2012 | Kirk |
| 8,262,411 | B2 | 9/2012 | Kondo |
| 8,272,877 | B2 | 9/2012 | Stokoe et al. |
| 8,337,247 | B2 | 12/2012 | Zhu |
| 8,348,701 | B1 | 1/2013 | Lan et al. |
| 8,371,875 | B2 | 2/2013 | Gailus |
| 8,382,524 | B2 | 2/2013 | Khilchenko et al. |
| 8,440,637 | B2 | 5/2013 | Elmen |
| 8,480,432 | B2 | 7/2013 | Wu |
| 8,506,319 | B2 | 8/2013 | Ritter et al. |
| 8,506,331 | B2 | 8/2013 | Wu |
| 8,545,253 | B2 | 10/2013 | Amidon et al. |
| 8,550,861 | B2 | 10/2013 | Cohen et al. |
| 8,597,051 | B2 | 12/2013 | Yang et al. |
| 8,657,627 | B2 | 2/2014 | McNamara et al. |
| 8,715,003 | B2 | 5/2014 | Buck et al. |
| 8,715,005 | B2 | 5/2014 | Pan |
| 8,740,637 | B2 | 6/2014 | Wang et al. |
| 8,764,492 | B2 | 7/2014 | Chiang |
| 8,771,016 | B2 | 7/2014 | Atkinson et al. |
| 8,864,506 | B2 | 10/2014 | Little |
| 8,864,521 | B2 | 10/2014 | Atkinson et al. |
| 8,905,777 | B2 | 12/2014 | Zhu et al. |
| 8,926,377 | B2 | 1/2015 | Kirk et al. |
| 8,944,831 | B2 | 2/2015 | Stoner et al. |
| 8,968,034 | B2 | 3/2015 | Hsu |
| 8,998,642 | B2 | 4/2015 | Manter et al. |
| 9,004,942 | B2 | 4/2015 | Paniagua |
| 9,011,177 | B2 | 4/2015 | Lloyd et al. |
| 9,022,806 | B2 | 5/2015 | Cartier, Jr. et al. |
| 9,028,281 | B2 | 5/2015 | Kirk et al. |
| 9,065,230 | B2 | 6/2015 | Milbrand, Jr. |
| 9,124,009 | B2 | 9/2015 | Atkinson et al. |
| 9,219,335 | B2 | 12/2015 | Atkinson et al. |
| 9,225,085 | B2 | 12/2015 | Cartier, Jr. et al. |
| 9,257,794 | B2 | 2/2016 | Wanha et al. |
| 9,263,835 | B2 | 2/2016 | Guo |
| 9,281,590 | B1 | 3/2016 | Liu et al. |
| 9,287,668 | B2 | 3/2016 | Chen et al. |
| 9,300,074 | B2 | 3/2016 | Gailus |
| 9,337,585 | B1 | 5/2016 | Yang |
| 9,350,095 | B2 | 5/2016 | Arichika et al. |
| 9,450,344 | B2 | 9/2016 | Cartier, Jr. et al. |
| 9,484,674 | B2 | 11/2016 | Cartier, Jr. et al. |
| 9,509,101 | B2 | 11/2016 | Cartier, Jr. et al. |
| 9,520,686 | B2 | 12/2016 | Hu et al. |
| 9,520,689 | B2 | 12/2016 | Cartier, Jr. et al. |
| 9,537,250 | B2 | 1/2017 | Kao et al. |
| 9,640,915 | B2 | 5/2017 | Phillips |
| 9,692,183 | B2 | 6/2017 | Phillips |
| 9,742,132 | B1 | 8/2017 | Hsueh |
| 9,843,135 | B2 | 12/2017 | Guetig et al. |
| 9,972,945 | B1 | 5/2018 | Huang et al. |
| 9,997,871 | B2 | 6/2018 | Zhong |
| 10,122,129 | B2 | 11/2018 | Milbrand, Jr. et al. |
| 10,135,197 | B2 | 11/2018 | Little et al. |
| 10,211,577 | B2 | 2/2019 | Milbrand, Jr. et al. |
| 10,243,304 | B2 | 3/2019 | Kirk et al. |
| 10,270,191 | B1 | 4/2019 | Li et al. |
| 10,276,995 | B2 | 4/2019 | Little |
| 10,283,910 | B1 | 5/2019 | Chen et al. |
| 10,348,040 | B2 | 7/2019 | Cartier, Jr. et al. |
| 10,381,767 | B1 | 8/2019 | Milbrand, Jr. et al. |
| 10,431,936 | B2 | 10/2019 | Horning et al. |
| 10,511,128 | B2 | 12/2019 | Kirk et al. |
| 10,541,482 | B2 | 1/2020 | Sasame et al. |
| 10,601,181 | B2 | 3/2020 | Lu et al. |
| 10,777,921 | B2 | 9/2020 | Lu et al. |
| 10,797,446 | B2 | 10/2020 | Liu et al. |
| 10,840,622 | B2 | 11/2020 | Sasame et al. |
| 10,965,064 | B2 | 3/2021 | Hsu et al. |
| 2001/0042632 | A1 | 11/2001 | Manov et al. |
| 2001/0046810 | A1 | 11/2001 | Cohen et al. |
| 2002/0042223 | A1 | 4/2002 | Belopolsky et al. |
| 2002/0061671 | A1 | 5/2002 | Torii |
| 2002/0089464 | A1 | 7/2002 | Joshi |
| 2002/0098738 | A1 | 7/2002 | Astbury, Jr. et al. |
| 2002/0111068 | A1 | 8/2002 | Cohen et al. |
| 2002/0111069 | A1 | 8/2002 | Astbury, Jr. et al. |
| 2002/0132518 | A1 | 9/2002 | Kobayashi |
| 2003/0119360 | A1 | 6/2003 | Jiang et al. |
| 2004/0005815 | A1 | 1/2004 | Mizumura et al. |
| 2004/0020674 | A1 | 2/2004 | McFadden et al. |
| 2004/0058572 | A1 | 3/2004 | Fromm et al. |
| 2004/0115968 | A1 | 6/2004 | Cohen |
| 2004/0121652 | A1 | 6/2004 | Gailus |
| 2004/0196112 | A1 | 10/2004 | Welbon et al. |
| 2004/0259419 | A1 | 12/2004 | Payne et al. |
| 2005/0048818 | A1 | 3/2005 | Pan |
| 2005/0070160 | A1 | 3/2005 | Cohen et al. |
| 2005/0133245 | A1 | 6/2005 | Katsuyama et al. |
| 2005/0176835 | A1 | 8/2005 | Kobayashi et al. |
| 2005/0233610 | A1 | 10/2005 | Tutt et al. |
| 2005/0283974 | A1 | 12/2005 | Richard et al. |
| 2005/0287869 | A1 | 12/2005 | Kenny et al. |
| 2006/0019525 | A1 | 1/2006 | Lloyd et al. |
| 2006/0068640 | A1 | 3/2006 | Gailus |
| 2006/0255876 | A1 | 11/2006 | Kushta et al. |
| 2007/0004282 | A1 | 1/2007 | Cohen et al. |
| 2007/0021001 | A1 | 1/2007 | Laurx et al. |
| 2007/0037419 | A1 | 2/2007 | Sparrowhawk |
| 2007/0042639 | A1 | 2/2007 | Manter et al. |
| 2007/0054554 | A1 | 3/2007 | Do et al. |
| 2007/0059961 | A1 | 3/2007 | Cartier et al. |
| 2007/0155241 | A1 | 7/2007 | Lappohn |
| 2007/0197063 | A1 | 8/2007 | Ngo et al. |
| 2007/0218765 | A1 | 9/2007 | Cohen et al. |
| 2007/0243764 | A1 | 10/2007 | Liu et al. |
| 2007/0293084 | A1 | 12/2007 | Ngo |
| 2008/0020640 | A1 | 1/2008 | Zhang et al. |
| 2008/0194146 | A1 | 8/2008 | Gailus |
| 2008/0246555 | A1 | 10/2008 | Kirk et al. |
| 2008/0248658 | A1 | 10/2008 | Cohen et al. |
| 2008/0248659 | A1 | 10/2008 | Cohen et al. |
| 2008/0248660 | A1 | 10/2008 | Kirk et al. |
| 2009/0011641 | A1 | 1/2009 | Cohen et al. |
| 2009/0011645 | A1 | 1/2009 | Laurx et al. |
| 2009/0035955 | A1 | 2/2009 | McNamara |
| 2009/0061661 | A1 | 3/2009 | Shuey et al. |
| 2009/0117386 | A1 | 5/2009 | Vacanti et al. |
| 2009/0203259 | A1 | 8/2009 | Nguyen et al. |
| 2009/0239395 | A1 | 9/2009 | Cohen et al. |
| 2009/0258516 | A1 | 10/2009 | Hiew et al. |
| 2009/0291593 | A1 | 11/2009 | Atkinson et al. |
| 2009/0305530 | A1 | 12/2009 | Ito et al. |
| 2009/0305533 | A1 | 12/2009 | Feldman et al. |
| 2009/0305553 | A1 | 12/2009 | Thomas et al. |
| 2010/0048058 | A1 | 2/2010 | Morgan et al. |
| 2010/0068934 | A1 | 3/2010 | Li et al. |
| 2010/0081302 | A1 | 4/2010 | Atkinson et al. |
| 2010/0112846 | A1 | 5/2010 | Kotaka |
| 2010/0124851 | A1 | 5/2010 | Xiong et al. |
| 2010/0144167 | A1 | 6/2010 | Fedder et al. |
| 2010/0203772 | A1 | 8/2010 | Mao et al. |
| 2010/0291806 | A1 | 11/2010 | Minich et al. |
| 2010/0294530 | A1 | 11/2010 | Atkinson et al. |
| 2011/0003509 | A1 | 1/2011 | Gailus |
| 2011/0067237 | A1 | 3/2011 | Cohen et al. |

(56) References Cited

U.S. PATENT DOCUMENTS

| | | | |
|---|---|---|---|
| 2011/0104948 | A1 | 5/2011 | Girard, Jr. et al. |
| 2011/0130038 | A1 | 6/2011 | Cohen et al. |
| 2011/0143605 | A1 | 6/2011 | Pepe |
| 2011/0212649 | A1 | 9/2011 | Stokoe et al. |
| 2011/0212650 | A1 | 9/2011 | Amleshi et al. |
| 2011/0230095 | A1 | 9/2011 | Atkinson et al. |
| 2011/0230096 | A1 | 9/2011 | Atkinson et al. |
| 2011/0256739 | A1 | 10/2011 | Toshiyuki et al. |
| 2011/0287663 | A1 | 11/2011 | Gailus et al. |
| 2012/0094536 | A1 | 4/2012 | Khilchenko et al. |
| 2012/0156929 | A1 | 6/2012 | Manter et al. |
| 2012/0184145 | A1 | 7/2012 | Zeng |
| 2012/0184154 | A1 | 7/2012 | Frank et al. |
| 2012/0202363 | A1 | 8/2012 | McNamara et al. |
| 2012/0202386 | A1 | 8/2012 | McNamara et al. |
| 2012/0214344 | A1 | 8/2012 | Cohen et al. |
| 2013/0012038 | A1 | 1/2013 | Kirk et al. |
| 2013/0017733 | A1 | 1/2013 | Kirk et al. |
| 2013/0065454 | A1 | 3/2013 | Milbrand Jr. |
| 2013/0078870 | A1 | 3/2013 | Milbrand, Jr. |
| 2013/0078871 | A1 | 3/2013 | Milbrand, Jr. |
| 2013/0090001 | A1 | 4/2013 | Kagotani |
| 2013/0109232 | A1 | 5/2013 | Paniaqua |
| 2013/0143442 | A1 | 6/2013 | Cohen et al. |
| 2013/0196553 | A1 | 8/2013 | Gailus |
| 2013/0217263 | A1 | 8/2013 | Pan |
| 2013/0225006 | A1 | 8/2013 | Khilchenko et al. |
| 2013/0237100 | A1 | 9/2013 | Affeltranger |
| 2013/0316590 | A1 | 11/2013 | Hon |
| 2014/0004724 | A1 | 1/2014 | Cartier, Jr. et al. |
| 2014/0004726 | A1 | 1/2014 | Cartier, Jr. et al. |
| 2014/0004746 | A1 | 1/2014 | Cartier, Jr. et al. |
| 2014/0024263 | A1 | 1/2014 | Dong et al. |
| 2014/0057498 | A1 | 2/2014 | Cohen |
| 2014/0113487 | A1 | 4/2014 | Chen et al. |
| 2014/0273557 | A1 | 9/2014 | Cartier, Jr. et al. |
| 2014/0273627 | A1 | 9/2014 | Cartier, Jr. et al. |
| 2014/0377992 | A1 | 12/2014 | Chang et al. |
| 2015/0056856 | A1 | 2/2015 | Atkinson et al. |
| 2015/0072546 | A1 | 3/2015 | Li |
| 2015/0111401 | A1 | 4/2015 | Guo |
| 2015/0111427 | A1 | 4/2015 | Foxconn |
| 2015/0126068 | A1 | 5/2015 | Fang |
| 2015/0140866 | A1 | 5/2015 | Tsai et al. |
| 2015/0214673 | A1 | 7/2015 | Gao et al. |
| 2015/0236451 | A1 | 8/2015 | Cartier, Jr. et al. |
| 2015/0236452 | A1 | 8/2015 | Cartier, Jr. et al. |
| 2015/0255904 | A1 | 9/2015 | Ito |
| 2015/0255926 | A1 | 9/2015 | Paniagua |
| 2015/0340798 | A1 | 11/2015 | Kao et al. |
| 2016/0149343 | A1 | 5/2016 | Atkinson et al. |
| 2016/0268744 | A1 | 9/2016 | Little et al. |
| 2017/0077654 | A1 | 3/2017 | Yao et al. |
| 2017/0352970 | A1 | 12/2017 | Liang et al. |
| 2018/0062323 | A1 | 3/2018 | Kirk et al. |
| 2018/0145438 | A1 | 5/2018 | Cohen |
| 2018/0198220 | A1 | 7/2018 | Sasame et al. |
| 2018/0205177 | A1 | 7/2018 | Zhou et al. |
| 2018/0212376 | A1 | 7/2018 | Wang et al. |
| 2018/0212385 | A1 | 7/2018 | Little |
| 2018/0219331 | A1 | 8/2018 | Cartier et al. |
| 2018/0241156 | A1 | 8/2018 | Huang et al. |
| 2018/0269607 | A1 | 9/2018 | Wu et al. |
| 2018/0331444 | A1 | 11/2018 | Ono |
| 2019/0006778 | A1 | 1/2019 | Fan et al. |
| 2019/0052019 | A1 | 2/2019 | Huang et al. |
| 2019/0067854 | A1 | 2/2019 | Ju et al. |
| 2019/0173209 | A1 | 6/2019 | Lu et al. |
| 2019/0173232 | A1 | 6/2019 | Lu et al. |
| 2019/0334292 | A1 | 10/2019 | Cartier, Jr. et al. |
| 2020/0021052 | A1 | 1/2020 | Milbrand, Jr. et al. |
| 2020/0153134 | A1 | 5/2020 | Sasame et al. |
| 2020/0203865 | A1 | 6/2020 | Wu et al. |
| 2020/0203867 | A1 | 6/2020 | Lu |
| 2020/0203886 | A1 | 6/2020 | Wu et al. |
| 2020/0235529 | A1 | 7/2020 | Kirk et al. |
| 2020/0259294 | A1 | 8/2020 | Lu |
| 2020/0266584 | A1 | 8/2020 | Lu |
| 2020/0335914 | A1 | 10/2020 | Hsu et al. |
| 2020/0358226 | A1 | 11/2020 | Lu et al. |
| 2020/0395698 | A1 | 12/2020 | Hou et al. |
| 2020/0403350 | A1 | 12/2020 | Hsu |
| 2021/0050683 | A1 | 2/2021 | Sasame et al. |
| 2021/0135389 | A1 | 5/2021 | Jiang |
| 2021/0135404 | A1 | 5/2021 | Jiang |
| 2021/0218195 | A1 | 7/2021 | Hsu et al. |

FOREIGN PATENT DOCUMENTS

| | | | |
|---|---|---|---|
| CN | 1179448 | C | 12/2004 |
| CN | 1650479 | A | 8/2005 |
| CN | 1799290 | A | 7/2006 |
| CN | 2896615 | Y | 5/2007 |
| CN | 2930006 | Y | 8/2007 |
| CN | 101019277 | A | 8/2007 |
| CN | 101176389 | A | 5/2008 |
| CN | 101208837 | A | 6/2008 |
| CN | 101312275 | A | 11/2008 |
| CN | 201323275 | Y | 10/2009 |
| CN | 101600293 | A | 12/2009 |
| CN | 201374434 | Y | 12/2009 |
| CN | 101752700 | A | 6/2010 |
| CN | 101790818 | A | 7/2010 |
| CN | 101120490 | B | 11/2010 |
| CN | 101926055 | A | 12/2010 |
| CN | 201846527 | U | 5/2011 |
| CN | 102106041 | A | 6/2011 |
| CN | 102224640 | A | 10/2011 |
| CN | 102232259 | A | 11/2011 |
| CN | 102239605 | A | 11/2011 |
| CN | 102292881 | A | 12/2011 |
| CN | 101600293 | B | 5/2012 |
| CN | 102487166 | A | 6/2012 |
| CN | 102593661 | A | 7/2012 |
| CN | 102598430 | A | 7/2012 |
| CN | 202395248 | U | 8/2012 |
| CN | 102738621 | A | 10/2012 |
| CN | 102859805 | A | 1/2013 |
| CN | 202695788 | U | 1/2013 |
| CN | 202695861 | U | 1/2013 |
| CN | 203445304 | U | 2/2014 |
| CN | 103840285 | A | 6/2014 |
| CN | 203690614 | U | 7/2014 |
| CN | 204030057 | U | 12/2014 |
| CN | 204167554 | U | 2/2015 |
| CN | 104409906 | A | 3/2015 |
| CN | 104577577 | A | 4/2015 |
| CN | 204349140 | U | 5/2015 |
| CN | 106099546 | A | 11/2016 |
| CN | 107069281 | A | 8/2017 |
| CN | 304240766 | S | 8/2017 |
| CN | 304245430 | S | 8/2017 |
| CN | 206712089 | U | 12/2017 |
| CN | 207677189 | U | 7/2018 |
| CN | 208078300 | U | 11/2018 |
| DE | 60216728 | T2 | 11/2007 |
| EP | 0560551 | A1 | 9/1993 |
| EP | 1018784 | A1 | 7/2000 |
| EP | 1779472 | A1 | 5/2007 |
| EP | 2169770 | A2 | 3/2010 |
| EP | 2405537 | A1 | 1/2012 |
| GB | 1272347 | A | 4/1972 |
| JP | H3-156761 | A2 | 7/1991 |
| JP | 07302649 | A | 11/1995 |
| JP | 2001-510627 | A | 7/2001 |
| JP | 2002-151190 | A2 | 5/2002 |
| JP | 2006-344524 | A | 12/2006 |
| MX | 9907324 | A1 | 8/2000 |
| TW | M357771 | U | 5/2009 |
| TW | M474278 | U | 3/2014 |
| TW | I535129 | B | 5/2016 |
| TW | I596840 | B | 8/2017 |
| TW | M558481 | U | 4/2018 |
| TW | M558482 | U | 4/2018 |

(56) References Cited

FOREIGN PATENT DOCUMENTS

| | | | |
|---|---|---|---|
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |
| WO | WO 2010/030622 | A1 | 3/2010 |
| WO | WO 2010/039188 | A1 | 4/2010 |
| WO | 2011/100740 | A2 | 8/2011 |
| WO | WO 2017/007429 | A1 | 1/2017 |

OTHER PUBLICATIONS

U.S. Appl. No. 16/556,728, filed Aug. 30, 2019, Lu.
U.S. Appl. No. 16/556,778, filed Aug. 30, 2019, Lu.
International Search Report and Written Opinion for International Application No. PCT/CN2017/108344 dated Aug. 1, 2018.
International Search Report and Written Opinion for International Application No. PCT/US2010/056482 dated Mar. 14, 2011.
International Preliminary Report on Patentability for International Application No. PCT/US2010/056482 dated May 24, 2012.
International Search Report and Written Opinion for International Application No. PCT/US2011/026139 dated Nov. 22, 2011.
International Preliminary Report on Patentability for International Application No. PCT/US2011/026139 dated Sep. 7, 2012.
International Search Report and Written Opinion for International Application No. PCT/US2012/023689 dated Sep. 12, 2012.
International Preliminary Report on Patentability for International Application No. PCT/US2012/023689 dated Aug. 15, 2013.
International Search Report and Written Opinion for International Application No. PCT/US2012/060610 dated Mar. 29, 2013.
International Search Report and Written Opinion for International Application No. PCT/U52015/012463 dated May 13, 2015.
International Search Report and Written Opinion for International Application No. PCT/US2017/047905 dated Dec. 4, 2017.
Extended European Search Report for European Application No. EP 11166820.8 dated Jan. 24, 2012.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Search Report and Written Opinion for International Application No. PCT/US2011/034747 dated Jul. 28, 2011.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
Beaman, High Performance Mainframe Computer Cables. 1997 Electronic Components and Technology Conference. 1997;911-7.
Shi et al, Improving Signal Integrity in Circuit Boards by Incorporating Absorbing Materials. 2001 Proceedings. 51st Electronic Components and Technology Conference, Orlando FL. 2001:1451-56.
Chinese communication for Chinese Application No. 201580014851.4, dated Jun. 1, 2020.
Chinese Office Action dated Jan. 18, 2021 in connection with Chinese Application No. 202010031395.7.
Chinese Office Action for Application No. 201680051491.X dated Apr. 30, 2019.
Chinese Office Action for Chinese Application No. 201580014851.4 dated Sep. 4, 2019.
Chinese Office Action for Chinese Application No. 201780064531.9 dated Jan. 2, 2020.
Chinese Office Action for Chinese Application No. 201780097919.9, dated Mar. 10, 2021.
Extended European Search Report dated May 19, 2021 in connection with European Application No. 17930428.2.
International Preliminary Report on Patentability Chapter II for International Application No. PCT/CN2017/108344 dated Mar. 6, 2020.
International Preliminary Report on Patentability for International Application No. PCT/SG2016/050317 dated Jan. 18, 2018.
International Search Report and Written Opinion for International Application No. PCT/SG2016/050317 dated Oct. 18, 2016.
[No Author Listed], High Speed Backplane Connectors. Tyco Electronics. Product Catalog No. 1773095. Revised Dec. 2008. 1-40 pages.
[No Author Listed], Military Fibre Channel High Speed Cable Assembly, www.gore.com. 2008. [last accessed Aug. 2, 2012 via Internet Archive: Wayback Machine http://web.archive.org] Link archived: http://www.gore.com/en.sub.—xx/products/cables/copper/networking/militar-y/military.sub.—fibre . . . Last archive date Apr. 6, 2008.
[No Author Listed], SFF-TA-1016 Specification for Internal Unshielded High Speed Connector System. Rev 0.0.1. SNIA SFF TWG Technology Affiliate. Nov. 15, 2019. 40 pages.
Reich et al., Microwave Theory and Techniques. Boston Technical Publishers, Inc. 1965; 182-91.

* cited by examiner

CONNECTOR HAVING METAL SHELL WITH ANTI-DISPLACEMENT STRUCTURE

CROSS-REFERENCE TO RELATED APPLICATIONS

This application claims priority to and the benefit of Taiwanese Patent Application No. 107215544, filed on Nov. 15, 2018 and entitled "METAL SHELL WITH ANTI-DISPLACEMENT STRUCTURE AND CONNECTOR THEREOF." The entire contents of this application is incorporated herein by reference in its entirety.

TECHNICAL FIELD

The present disclosure relates to a miniaturized electrical connector.

BACKGROUND

With the advancement of communication technology and electronic manufacturing techniques, portable electronic devices have become indispensable tools in modern people's life and work. Portable devices may perform various functions, such as mobile phones that allow people to communicate around the world, portable music players that allow people to listen to music anywhere at any time, personal computers that assist people in handling numerous tasks, portable power source devices that can be carried for continuous power supply for a mobile phone, etc.

For many electronic devices (e.g., smart phones, tablet computers, desktop computers, notebook computers, digital cameras and so on), in order to receive electronic signals and power from the outside, it is usually necessary to configure an electrical connector on the body of each electronic device. In general, electrical connectors refer to connecting components and their accessories applied to electronic signals and power sources. They pass signals to and from the devices, and the quality of the connectors affects the reliability of power and signal transmission such that the quality of a connector is impacts the operation of electronic devices. Further, electrical connectors enable multiple electronic devices to be connected into a complete system so as to transmit electronic signals or power to each other. Thus it can be seen that the electrical connectors are an essential component for an electronic device to realize many functions.

The electrical connector serves as an important communication bridge among a plurality of electronic devices, so that the structural strength and durability thereof have always been valued, and operators will also continuously and repeatedly check the quality of each component of the connector during production. Further, most of the current signal connectors are each composed of an insulating base and a metal shell, in which the metal shell has the effects of preventing electromagnetic interference (EMI), serving as a grounding way, protecting the insulating base, etc.

BRIEF SUMMARY

Described herein is a miniaturized electrical connector with enhanced structural strength.

In accordance with one aspect, a metal shell for an electrical connector with an anti-displacement structure, which can be assembled onto an insulating base. The metal shell may comprise a body, at least one first upper fixing part, at least one first lower fixing part and at least one first positioning part, wherein the body has a cross section that is at least U-shaped to form an assembly space running from front to back between two side arms of the body so that the insulating base can be located in the assembly space; the first upper fixing part is located at an inner side face of one of the side arms of the body and can abut against an upper surface of the insulating base; the first lower fixing part is located at an inner side face of the one or the other side arm of the body and can abut against a lower surface of the insulating base, so that the insulating base is fixed between the first upper fixing part and the first lower fixing part and thus the insulating base cannot move upward or downward relative to the metal shell; and the first positioning part is located on one of the side arms of the body, and can be combined with a second positioning part of the insulating base so that the insulating base cannot move forward or backward relative to the metal shell. In this way, by means of the above structure, the metal shell can be stably assembled onto the insulating base and thus cannot be easily detached therefrom.

In accordance with another aspect, an electrical connector with an anti-displacement structure may comprise an insulating base, a plurality of metal terminals and a metal shell. The metal terminals may be fixedly arranged in the insulating base. The metal shell may be assembled onto the insulating base, and comprises a body, at least one first upper fixing part, at least one first lower fixing part and at least one first positioning part. The body may have a cross section that is at least U-shaped to form an assembly space running from front to back between two side arms of the body so that the insulating base can be located in the assembly space. The first upper fixing part may be located at an inner side face of one of the side arms of the body and can abut against an upper surface of the insulating base. The first lower fixing part is located at an inner side face of the one or the other side arm of the body and can abut against a lower surface of the insulating base, so that the insulating base is fixed between the first upper fixing part and the first lower fixing part and thus the insulating base cannot move upward or downward relative to the metal shell. The first positioning part may be located on one of the side arms of the body, and can be combined with a second positioning part of the insulating base so that the insulating base cannot move forward or backward relative to the metal shell. In this way, by means of the above structure, both the insulating base and the metal shell have high assembly stability, ensuring the safety in use and the reliability of products.

In a further aspect, an electrical connector may be provided. The connector may have an insulative housing comprising a projection and a slot configured to receive at least a portion of a mating plug connector inserted into the slot in an insertion direction. The connector may metal shell comprising a first side arm adjacent a first side of the insulative housing and a second side arm adjacent a second side, opposite the first side, of the insulative housing. The metal shell may comprise an opening receiving the projection from the insulative housing such that motion of the metal shell relative to the insulative housing in a direction parallel to the insertion direction is restrained. The metal shell may also have at least one projection engaging a first surface of the housing and a second surface of the housing, facing in a direction opposite the first surface, such that motion of the metal shell relative to the insulative housing in a first direction perpendicular to the insertion direction is restrained.

In order to facilitate further understanding of the purpose, technical features and effects, the following detailed description is provided in conjunction with exemplary embodiments and the accompanying drawings:

DETAILED DESCRIPTION

The inventors have recognized and appreciated that, during use, for certain electrical connectors that are mounted to printed circuit boards and then other electrical connectors are plugged into them, an insulating base of the electrical connector will often be under a large force in the plugging and unplugging process. For connectors with a metal shell, this large amount of force can detach the insulating base from the metal shell, thus causing the electrical connector to fail.

The present application discloses designs that improve the structure of an electrical connector to enable the electrical connector to have good structural stability in use, thus reducing the risk of damage to the connector when a mating connector is plugged or unplugged. The present application relates to an electrical connector with a metal shell with an anti-displacement structure. Such a metal shell may prevent the insulating base from moving upward, downward, forward and/or backward. In accordance with some embodiments, the metal shell and insulating base may be configured with features that restrain motion of the metal shell with respect to the insulating base of the connector in multiple directions. Nonetheless, the connector may be simply constructed. Further, in some embodiments, the restraining features do not expand the dimensions of the connector.

Figure 1:
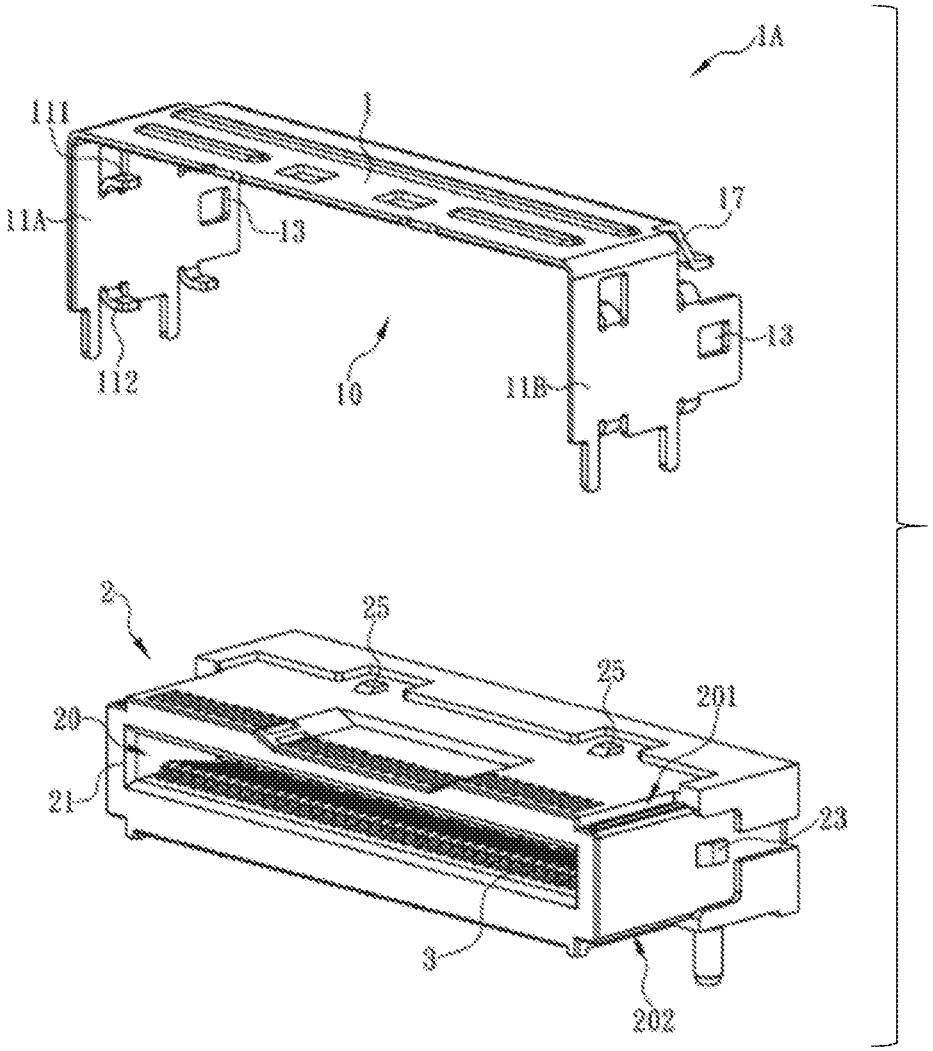
FIG. 1 is a front exploded perspective view of an exemplary embodiment of a connector.
Figure 2:
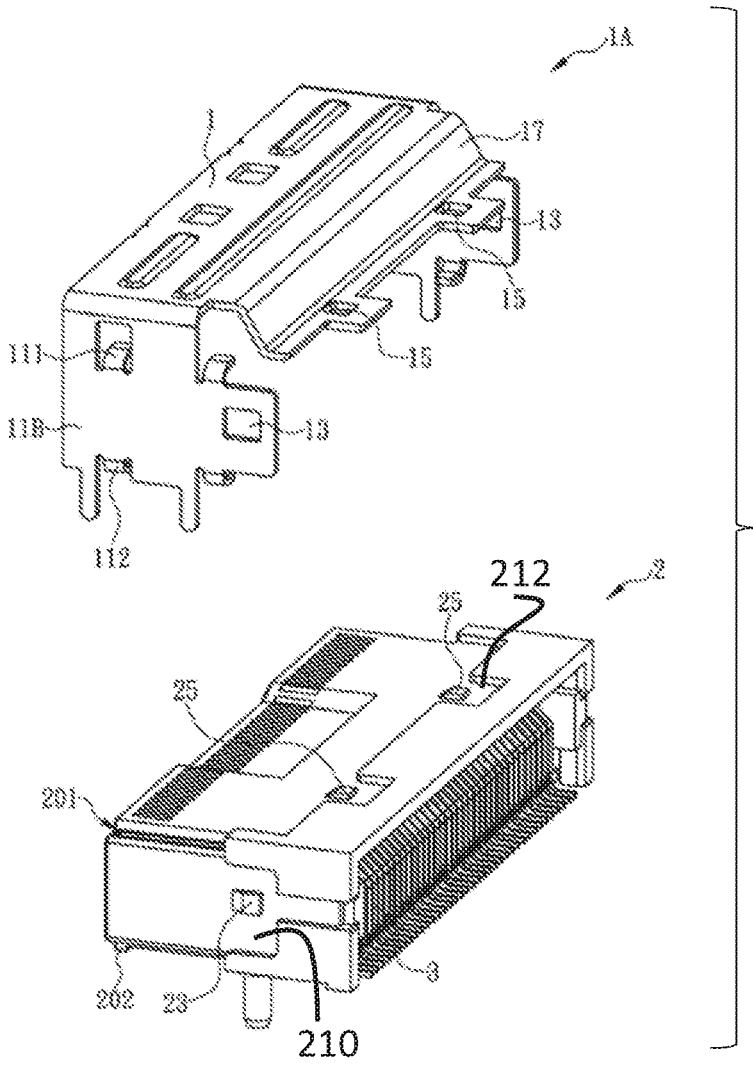
FIG. 2 is a rear exploded perspective view of an exemplary embodiment of a connector.

FIGS. 1-2 illustrate an exemplary embodiment of a connector with a metal shell 1A and an insulating base 2. For convenience of explanation, the upper part in FIG. 1 is taken as an upper position of the connector, and the lower part of FIG. 1 is taken as a lower position of the connector. With this nomenclature, the lower portion of the connector is configured for mounting to a printed circuit board. The lower left part of FIG. 1 is taken as a front position of the connector, and the upper right part of FIG. 1 is taken as a rear position of the connector. With this nomenclature, the front of the connector includes a mating interface that receives a mating plug connector. In the example of FIGS. 1 and 2, the connector is figured as a right angle connector, such that the front of the connector is at 90 degrees relative to the lower portion of the connector. However, it should be appreciated that a connector may be configured with a housing and a metal shell in other orientations. The connector, for example, may be configured as a vertical connector in which the mating interface is parallel with and above the mounting interface. Accordingly, the invention is not limited to the specific connector configuration illustrated.

Referring again to FIGS. 1 and 2, in this embodiment, a front side of the insulating base 2 is provided with a mating interface 21 at which connections between the receptacle connector illustrated in FIG. 1 and a mating plug connector can be made. In this example, mating interface 21 includes a slot 20 in insulating base 2. The insulating base may serve as a housing for one or more conductive members that carry signals and or ground through the connector. In this example, a plurality of metal terminals 3, are held within the insulating base 2. As can be seen in the front view of FIG. 1, the metal terminals 3 have mating contact portions that are exposed in slot 20 such that they can make connection to pads on a component of a plug connector inserted into slot 20. In this example, the mating contact portions of the terminals 3 line opposing walls of the slot. Such a mating interface may receive, and make contact to, a paddle card of a plug connector In the illustrated embodiment, the metal terminals 3 may be at least one of a signal terminal, a ground terminal and a power terminal, and are respectively fixedly arranged in the insulating base 2 at a distance from each other. The metal terminals 3 may be arranged on a uniform pitch, such as 0.6 mm center-to-center or less. Front ends of the metal terminals 3, at which the mating contact portions are located, can be exposed within the slot 20 (as shown in FIG. 1), and when a further connector (not shown in the figure) is in plugged into the receptacle connector, terminals of the further connector can extend into the slot 20 and are electrically connected to the mating contact portions of the metal terminals 3, completing electrical connections between the plug connector and the receptacle connector.

As can be seen in FIG. 2, the rear ends of the terminals 3 may serve as contact tails that may be attached to a printed circuit board. In this example, the contact tails are configured as surface mount contact tails, and the receptacle connector of FIGS. 1 and 2 may be mounted to a printed circuit board (PCB) by surface mount solder techniques. As a result, insertion of a plug into mating interface 21 may complete multiple connections from the plug connection, through the receptacle connector to the circuit board. In some embodiments, the plug connector may terminate a cable, forming a cable assembly, such that inserting the plug into the receptacle connector connects conductors of the cable to the printed circuit board, creating electrical connections between a location on the PCB adjacent the connector of FIGS. 1 and 2 and a remote location(s) to which an opposing end(s) of the cable are attached.

The insulating base 2 may be internally provided with a plurality of terminal slots for receiving the metal terminals 3. Alternatively or additionally, the insulating base 2 may have a tongue plate on which the metal terminals 3 are fixed. Regardless of the manner in which the metal terminals are integrated into insulating base 2, so long as the metal terminals 3 can be electrically connected to terminals of another connector, the connection between the metal terminals 3 and the plug connector may be formed, as stated previously.

Referring again to FIGS. 1 and 2, the metal shell 1A comprises a body 1, at least one first upper fixing part 111, at least one first lower fixing part 112, and at least one first positioning part 13. In this embodiment, the body 1 has a U-shaped cross section, enabling the metal shell to surround, at least partially, on three sides, the base 2. In other embodiments, the body 1 may have an approximately rectangular cross section or may be otherwise configured to surround, at least partially, an insulating base of a connector on four sides. However, the rectangular cross section mentioned above may be implemented as a U-shaped configuration, in which there is no shell adjacent one or more sides of the base 2. Alternatively or additionally, a metal shell with a rectangular cross section may have a related structure described later.

Regardless of the specific configuration of the metal shell 1A, it may form an assembly space configured to receive the base 2 of a receptacle connector. An assembly space 10 running from front to back may be formed, for example, between the two side arms 11A and 11B of the body 1, so that the insulating base 2 can be located in the assembly space 10. The metal shell 1A and the insulating base 2 can be attached to one another during an assembly operation, thereby forming the connector.

In the illustrated embodiment, referring again to FIGS. 1 and 2, a first upper fixing part 111 and a first lower fixing part 112 are respectively provided at inner side faces of both side arms 11A and 11B of the body 1. However, in other embodiments, the first upper fixing part 111 and the first lower fixing part 112 may be provided on only one of the side arms, such as side arm 11A. As a further alternative, the first upper fixing part 111 may be provided on one side arm, such as side arm 11A, while the first lower fixing part 112 may be provided on the other side arm, such as side arm 11B.

In the illustrated embodiment, the first upper fixing part 111 is integrally formed with the body 1. First upper fixing part 111 may be a tab formed from a part of the body 1 by stamping and bending the tab inwards. The first lower fixing part 112 may also be integrally formed with the body 1 and may also be formed by stamping a tab from a part of the body 1 and bending it inwards.

Figure 3:
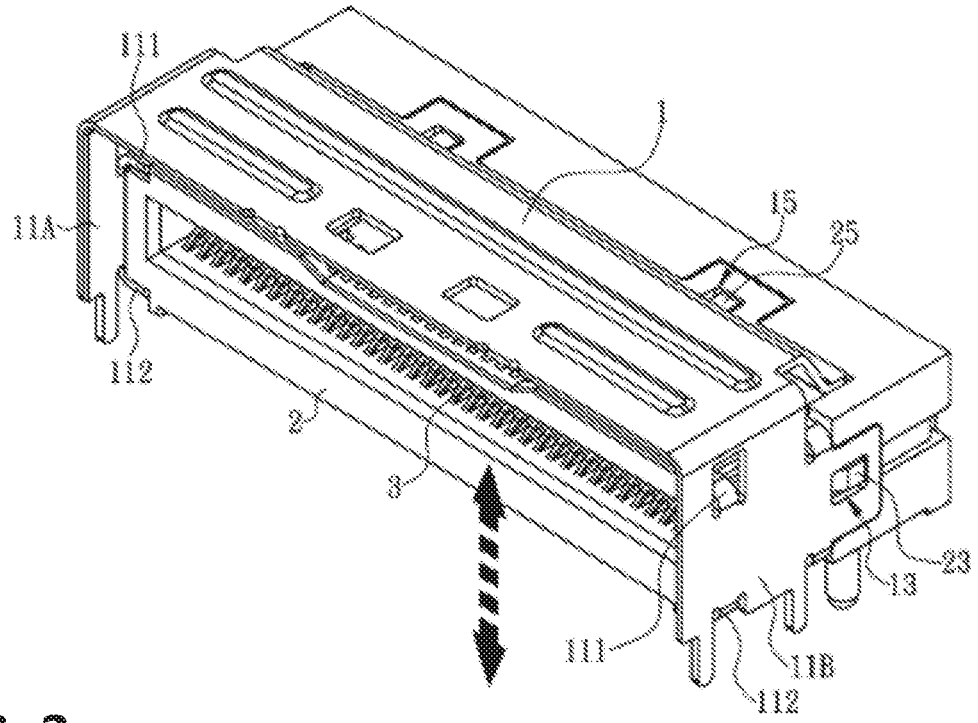
FIG. 3 is a front perspective view of an exemplary embodiment of a connector.

The first upper fixing part 111 may be bent such that, when the insulating base 2 is located in the assembly space 10, first upper fixing part 111 abuts the upper surface of the insulating base 2. The first lower fixing part 112 may be bent such that, when the insulating base 2 is located in the assembly space 10, first lower fixing part 112 abuts the lower surface of the insulating base 2. As a result, the insulating base 2 is fixed between the first upper fixing part 111 and the first lower fixing part 112. In this configuration, the insulating base 2 cannot move upward or downward relative to the metal shell 1A (as shown by the dotted arrow in FIG. 3).

Insulating base 2 may be formed with recesses that receive the first upper fixing part 111 and first lower fixing part 112. In the embodiment illustrated in FIGS. 1-2, top faces of the insulating base 2 adjacent to both sides thereof are each concavely provided with an upper channel 201, and bottom faces of the insulating base 2 adjacent to both sides thereof are each concavely provided with a lower slot 202. With the insulating base 2 located in the assembly space 10, each of the first upper fixing parts 111 can extend into and abut the insulating base 2 within a corresponding upper channel 201, and each of the first lower fixing parts 112 can extend into and abut the insulating base 2 in a corresponding lower slot 202. In this embodiment, as a result of the upper channel 201 and the lower slot 202, neither the first upper fixing part 111 extends above the upper surface of the insulating base 2 nor the first lower fixing part 112 extends below the lower surface of the insulating base 2. As a result, the connector may be miniaturized.

The channels 201 may extend to a face of the insulative base 2. In the illustrated embodiment of FIG. 2, the channels 201 extend to the mating face of the connector. In such a configuration, the insulative base may be inserted into the assembly space bounded by the walls of the shell after tabs, forming the fixing parts, are bent from the body of the shell.

To support an assembly process in which the insulative base is inserted into the shell, the projections 23 and 25 may have sides that are tapered, relative to the surface of the insulating base from which the projections extend and sides that are perpendicular to the surface of the insulating base. In this embodiment, the insulating base 2 may be inserted into the assembly space of the shell.

Portions of the shell including the positioning parts 13 and 15 may ride along the tapered portions, such that the shell is deflected and lifts off the surface of the insulating base 2. The portions of the shell may ride along the tapered portions until the positioning parts 13 and 15 are aligned with the projections 23 and 25. As the positioning parts 13 and 15 are here illustrated as openings, in this state, the projections 23 and 25 may align with the openings. The shell may then return to its un-deflected state with the projections in the openings. In this state, as illustrated for example in FIG. 3, portions of the shell are captured between the perpendicular portions of the projections 23 and 25 and steps in the insulating base separating the recesses 210 and 212 from un-recessed portions of the insulating base 2.

In some embodiments, an upper channel 201 and/or the lower slot 202 may be provided in the positions where the first upper fixing part 111 and the first lower fixing part 112 are disposed. In some embodiments, insulating base 2 may have a single upper channel 201 and a single lower slot 202, as long as the first upper fixing part 111 and the first lower fixing part 112 match the corresponding upper channel 201 and lower slot 202. Such a design limits the orientations in which the insulating base 2 may be inserted into the assembly space of the metal shell, and may avoid the incorrect assembly of the connector components.

Further attachment of the metal shell 1A to the insulating base 2 may be provided by engagement of positioning parts on the shell with complementary positioning parts on insulating base 2. In the embodiment of FIGS. 1 and 2, the first positioning parts 13 are shown as openings in a sidewall of the metal shell 1A and the complementary positioning parts are projections on sidewalls of insulating base 2. In this example, the two first positioning parts 13 are respectively located on the two side arms 11A, 11B of the body 1 and can be engaged with the second positioning part 23 of the insulating base 2.

The side arms 11A and 11B may fit within recesses 210 in the side walls of the insulating base 2. In the illustrated embodiment, the recesses 210 may have a depth such that the side arms 11A and 11B are flush with, or at least do not extend appreciably above the sidewalls of insulating base 2. On this configuration, an edge of the side arms but against a step in the insulating base 2, separating the recesses from un-recessed portions of the insulating base.

Figure 4:
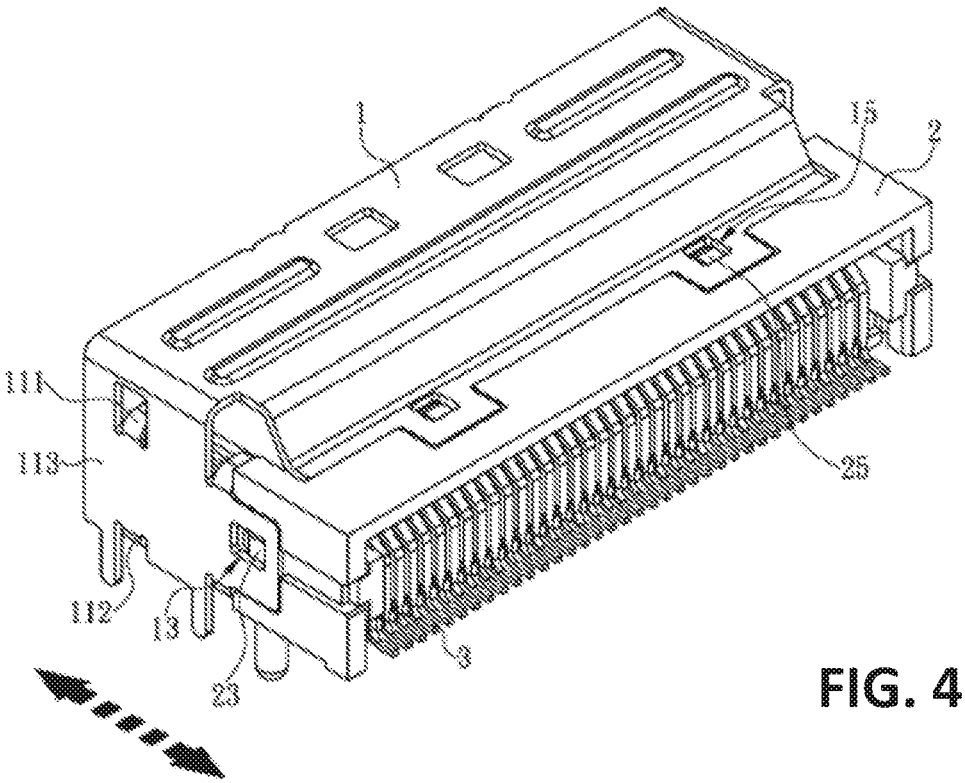
FIG. 4 is a rear perspective view of an exemplary embodiment of a connector.

However, in other embodiments, the body 1 can be provided with the first positioning part 13 only at one side arm 11A, and the insulating base 2 can also be just provided with a corresponding single second positioning part 23. In addition, in this embodiment, the first positioning part 13 is in the form of a snap-fit hole, and the second positioning part 23 is in a configuration of a snap-fit block, which projects from a surface of insulating base 2. With the insulating base 2 located in the assembly space 10, the snap-fit block can extend into the corresponding snap-fit hole, and thus the insulating base 2 cannot move forward or backward relative to the metal shell 1A (as shown by the dotted arrow in FIG. 4). Therefore, by means of the structure mentioned above, after the metal shell 1A and the insulating base 2 are assembled, the assembly stability of the two can be improved so as to, during the use of the connector, prevent the metal shell 1A from being detached from the insulating base 2 caused by plugging and unplugging a mating connector. As a result, operation of the connector is more reliable.

In order to further improve the stability of the connector assembly including metal shell 1A and the insulating base 2, referring again to FIGS. 1 to 2, a middle region of the body 1 (e.g., the positions other than the two side arms 11A and 11B are in the middle region) may be provided with at least one third positioning part 15. The insulating base 2 may be provided with at least one fourth positioning part 25, complimentary to the positioning part 15. In the illustrated embodiment, the third positioning part 15 is in the form of a snap-fit hole, and the fourth positioning part 25 is in a configuration of a snap-fit block. With the insulating base 2 located in the assembly space 10, the snap-fit block can extend into the corresponding snap-fit hole, so that the insulating base 2 cannot move forward or backward relative to the metal shell 1A (as shown by the dotted arrow in FIG. 4). In the illustrated embodiment, the positioning parts 15 are formed in portions of the body 1 that fit within recesses 212 in the upper surface of insulating base 2. The depth of recesses 212 may be approximately equal to the thickness of the body 1, such that recesses 212 may form a portion of the positioning part on insulating base 2.

In some embodiments, the shape of the insulating base 2 may be different than the shape of the assembly space within the metal shell 1A. In the embodiment illustrated, the insulating base is smaller than the assembly space. An inclined section 17 of metal shell 1A may be provided at a position, adjacent to a rear side, of the middle region of the body 1. The inclined section 17 may be configured such that the rear portions of body 1 may be engaged to the insulating base 2. In this example, the insulating base 2 and metal shell 1A may have dimensions that are independently established to accommodate receptacle and plug connectors of various sizes and configurations. Nonetheless, the insulating base 2 and metal shell 1A may be securely connected.

The above description is merely exemplary embodiments of the present invention. However, the scope of protection as claimed in the present invention is not limited thereto, and for a person skilled in the art, equivalent changes in accordance with the technical content disclosed in the present invention would have been readily conceivable without departing from the scope as claimed in the present invention.

What is claimed is:

1. A metal shell with an anti-displacement structure that can be assembled onto an insulating base, the metal shell comprising:

a body, comprising an assembly space running from front to back, the assembly space being bounded by at least two side arms of the body and a top portion so that the insulating base can be located in the assembly space;

at least one first upper fixing part, which is located at an inner side face of one of the side arms of the body and can abut against an upper surface of the insulating base;

at least one first lower fixing part, which is located at an inner side face of the one or the other side arm of the body and configured to abut against a lower surface of the insulating base so that the insulating base is fixed between the first upper fixing part and the first lower fixing part and thus the insulating base is restrained from movement upward or downward relative to the metal shell; and at least one first positioning part, which is located on one of the side arms of the body and configured to be combined with a second positioning part of the insulating base so that the insulating base is restrained from movement forward or backward relative to the metal shell;

wherein a first lower fixing part of the at least one first lower fixing part and a first positioning part of the at least one first positioning part are both located on the same side arm of the body and are separate from each other.

2. The metal shell of claim 1, wherein at least one third positioning part is further provided in a middle region of the body, and the third positioning part can be combined with a fourth positioning part of the insulating base so that the insulating base cannot move forward or backward relative to the metal shell.

3. The metal shell of claim 2, wherein the first positioning part comprises a snap-fit hole through which the second positioning part of the insulating base can be inserted into the first positioning part.

4. The metal shell of claim 3, wherein the third positioning part comprises a snap-fit hole through which the fourth positioning part of the insulating base can be inserted into the third positioning part.

5. The metal shell of claim 4, wherein the metal shell further comprises an inclined section adjacent to a rear side of the middle region of the body.

6. A connector with an anti-displacement structure, comprising:

an insulating base, which is provided with a plug-in port at a front side thereof comprising a receiving space;

a plurality of metal terminals, which are fixed in the insulating base and have front ends thereof exposed in the receiving space; and a metal shell comprising a body, at least one first upper fixing part, at least one first lower fixing part and at least one first positioning part, wherein the body has a cross section that is at least U-shaped to form an assembly space running from front to back between two side arms of the body so that the insulating base can be located in the assembly space;

wherein:

the first upper fixing part is located at an inner side face of one of the side arms of the body and abuts against an upper surface of the insulating base;

the first lower fixing part is located at an inner side face of the one or the other side arm of the body and can abut against a lower surface of the insulating base, so that the insulating base is fixed between the first upper fixing part and the first lower fixing part and thus the insulating base cannot move upward or downward relative to the metal shell; and the first positioning part is located on one of the side arms of the body, and can be combined with a second positioning part of the insulating base so that the insulating base cannot move forward or backward relative to the metal shell.

7. The connector of claim 6, wherein:

the metal shell further comprises at least one third positioning part in a middle region of the body, the insulating base further comprises at least one fourth positioning part, and the third positioning part is configured to be combined with the corresponding fourth positioning part so that the insulating base is restrained from moving forward or backward relative to the metal shell.

8. The connector of claim 7, wherein the metal shell further comprises an inclined section adjacent to a rear side of the middle region of the body.

9. The connector of claim 8, wherein a top face of the insulating base adjacent to one side thereof comprises an upper channel configured to receive the first upper fixing part.

10. The connector of claim 9, wherein a bottom face of the insulating base adjacent to the one or the other side thereof comprises a lower channel configured to receive the first lower fixing part.

11. An electrical connector, comprising:

an insulative housing comprising a projection and a slot configured to receive at least a portion of a mating plug connector inserted into the slot in an insertion direction;

a metal shell comprising a first side arm adjacent a first side of the insulative housing and a second side arm adjacent a second side, opposite the first side, of the insulative housing, wherein:

the metal shell comprises an opening receiving the projection from the insulative housing such that motion of the metal shell relative to the insulative housing in a direction parallel to the insertion direction is restrained; and the metal shell comprises at least one projection engaging a first surface of the housing and a second surface of the housing, facing in a direction opposite the first surface, such that motion of the metal shell relative to the insulative housing in a first direction perpendicular to the insertion direction is restrained.

12. The electrical connector of claim 11, wherein:

the first arm and a second arm and the second arm abut the insulative housing so as to restrain motion of the metal shell relative to the insulative housing in abase second direction perpendicular to the insertion direction and perpendicular to the first direction.

13. The electrical connector of claim 11, wherein:

the insulative housing comprises a recess separated from an un-recessed portion by a step of the insulative housing;

the projection of the insulative housing extends from the recess; and the metal shell is disposed at least in part within the at least one recess such that a portion of the metal shell is restrained between the projection of the insulative housing and the step of the insulative housing.

14. The electrical connector of claim 13, wherein:

the electrical connector comprises a first face and a second face;

the slot is in the first face;

the electrical connector comprises a plurality of terminals comprising mating contact portions and tails;

the mating contact portions of the plurality of terminals extend into the slot; and the contact tails are exposed at the second face; and the first face is orthogonal to the second face.

15. The electrical connector of claim 13, wherein:

the electrical connector comprises a first face and a second face;

the slot is in the first face;

the electrical connector comprises a plurality of terminals comprising mating contact portions and tails;

the mating contact portions of the plurality of terminals extend into the slot; and the contact tails are exposed at the second face; and the first face is parallel to the second face.

16. The electrical connector of claim 11, wherein:

the insulative housing comprises a first channel and a second channel;

the first surface is in the first channel;

the second surface is in the second channel;

the at least one projection of the metal shell comprises a first projection, extending into the first channel, and a second projection, extending into the second channel.

17. The electrical connector of claim 16, wherein:

the slot is in the mating face of the connector; and the first channel and the second channel extend to the mating face of the connector.

18. The electrical connector of claim 16, wherein:

the at least one projection of the metal shell further comprises a third projection, extending into the first channel, and a fourth projection, extending into the second channel.

19. The electrical connector of claim 18, wherein:

the first projection of the metal shell, the second projection of the metal shell, the third projection of the metal shell, and the fourth projection of the metal shell each comprises a tab cut from a body of the metal shell.

20. The electrical connector of claim 19, wherein:

the projection of the insulative housing is a projection of a plurality of projections of the insulative housing;

the opening of the metal shell is an opening of a plurality of openings; and the plurality of projections of the insulative housing are disposed within respective openings of the plurality of openings.

* * * * *